US006378565B1

(12) United States Patent
Best

(10) Patent No.: US 6,378,565 B1
(45) Date of Patent: Apr. 30, 2002

(54) PAPER MACHINE CLOTHING WITH FLAT TRANSVERSE THREADS

(75) Inventor: Walter Best, Duren (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/572,322

(22) Filed: May 18, 2000

(30) Foreign Application Priority Data

May 20, 1999 (DE) ..... 299 08 887 U

(51) Int. Cl.[7] ..... D21F 1/00
(52) U.S. Cl. ..... 139/383 A
(58) Field of Search ..... 139/383 A

(56) References Cited

U.S. PATENT DOCUMENTS 3,167,281 A 1/1965 Hill ..... 245/8
4,621,663 A 11/1986 Malmendier ..... 139/383
4,633,596 A * 1/1987 Josef ..... 139/383 A
4,829,681 A 5/1989 Josef ..... 34/123
5,713,398 A * 2/1998 Josef ..... 139/383 A
5,819,811 A * 10/1998 Baker et al. ..... 139/383 A

FOREIGN PATENT DOCUMENTS

EP 0155712 9/1985
EP 0580478 1/1994

* cited by examiner

*Primary Examiner*—Andy Falik
(74) *Attorney, Agent, or Firm*—Liniak, Berenato, Longacre & White, LLC

(57) ABSTRACT

A paper machine clothing, in particular a dryer fabric having a paper side provided for the support of a paper web and a machine side facing away therefrom, the paper machine clothing having a fabric made of longitudinal and transverse threads, the transverse threads including a paper-side thread system made up of flat transverse threads and a machine-side thread system made up of round transverse threads arranged such that at least two round transverse threads on the machine side lie in contact with at least some of the flat transverse threats, and such that one flat transverse thread and its round transverse threads lying in contact with it are together engaged by at least some of the longitudinal threads.

22 Claims, 1 Drawing Sheet

PAPER MACHINE CLOTHING WITH FLAT TRANSVERSE THREADS

FIELD OF THE INVENTION

The invention concerns a paper machine clothing, in particular as a dryer fabric, having a paper side provided for the support of a paper web and a machine side facing away therefrom, the paper machine clothing having or comprising a fabric made of longitudinal and transverse threads.

BACKGROUND OF THE INVENTION

A dryer fabric of this kind is disclosed in U.S. Pat. No. 4,621,663. It comprises a fabric having two longitudinal thread systems, the machine-side longitudinal thread system comprising round threads, and the paper-side longitudinal thread system comprising very wide flat threads. The machine-side longitudinal thread system engages into a double-ply machine-side transverse thread system. In addition to this transverse thread system, there is arranged between the two longitudinal thread systems a second transverse thread system made of flat transverse threads, which are engaged by the longitudinal threads of the two systems and thereby join the two longitudinal thread systems to one another. The flat transverse threads are at a relatively large spacing from one another, and are separated by the longitudinal threads from the round transverse wires of the first transverse thread system.

The known dryer fabric does form a very smooth surface on the paper side, and it has the disadvantage that it is very bulky and moreover complicated to manufacture.

The dryer fabric described in U.S. Pat. No. 4,829,681 has a simpler configuration. In one exemplary embodiment, all the transverse threads are configured as flat transverse threads that are engaged by the longitudinal threads. In this context, the longitudinal threads can also have an inverted U-shaped cross section. This cross section, however, provides high rigidity for the longitudinal threads, with the result that the longitudinal threads produce a highly buckled surface on the paper side, thus creating the risk of marks.

SUMMARY OF THE INVENTION

It is the object of the invention to configure a paper machine clothing of the kind cited initially in such a way that despite its smooth surface it has a simple configuration and consequently can be manufactured economically.

This object is achieved according to the present invention, in an embodiment having paper-side flat transverse threads and machine-side round transverse threads, in that in each case at least two round transverse threads on the machine side lie in contact with at least some of the flat transverse threads, and in each case one flat transverse thread and its round transverse threads lying in contact with it are together engaged by at least some of the longitudinal threads. The fundamental idea of the invention is thus to support the flat transverse threads with round transverse threads and thereby to improve dimensional stability. The paper machine clothing according to the present invention is also characterized by a simple configuration.

It is not necessary for the round transverse threads lying in contact with one flat transverse thread on the machine side to lie in contact with one another. Shifting of the round transverse threads with respect to the flat transverse threads is reduced, however, if the round transverse threads touch one another. In this context, the sum of the diameters of the round transverse threads that lie in contact with one flat transverse thread should not be greater than its extension in the longitudinal direction, so that the round transverse threads do not project beyond the flat transverse threads.

In a further embodiment of the invention, it is provided that no further transverse threads are present besides the flat transverse threads and the round transverse threads lying in contact with them, i.e. that what is always present is a combination of flat transverse threads and round transverse threads supporting them. As an alternative to this, however, it can also be provided that some of the longitudinal threads engage the flat transverse threads only on the paper side, and otherwise engage only with round transverse threads that extend between the round transverse threads lying in contact with the flat transverse threads.

The flat transverse threads advantageously have an extension in the longitudinal direction (machine direction) of the paper machine clothing of 1 to 25 mm, preferably 10 to 15 mm, and in the thickness direction (perpendicular to the plane of the paper machine clothing) of 0.2 to 1 mm. By definition, however, the term "flat transverse threads" always encompasses only those in which the thickness is less than the extension in the longitudinal direction of the paper machine clothing.

The stated object is also analogously achieved, according to the present invention, in that at least some of the transverse threads are configured as flat transverse threads onto which are shaped longitudinal ribs projecting on the machine side, the longitudinal ribs extending in the direction of the longitudinal axis of the flat transverse threads. This feature again provides dimensional stability for the transverse threads, and ensures that the smooth paper-side surface of the flat transverse threads remains as flat as possible and thus supports the paper web over a large area. Flat transverse threads of this kind can be manufactured by extrusion of the plastic material that is used.

The longitudinal ribs can be adapted to the respective requirements and manufacturing capabilities, and within this context can have any desired cross section. Rectangular, trapezoidal, and/or round cross sections are particularly appropriate. The number of longitudinal ribs is in principle not limited. Particularly favorable conditions are created if two or three longitudinal ribs are shaped next to one another.

The longitudinal threads can also be configured as flat threads. In this case the extension in the transverse direction of the paper machine clothing (width) should range from 0.5 to 5 mm, and in the thickness direction from 0.2 to 1 mm.

In order largely to prevent any shifting of the round transverse threads with respect to the flat transverse threads supported by them, the longitudinal threads should each engage only one flat transverse thread, i.e. somewhat in the manner of a plain weave, if the combination of flat and round transverse threads is viewed as a unit Lastly, provision is made according to the invention that, in the case of at least some of the longitudinal threads and preferably all the longitudinal threads, each two adjacent longitudinal threads form a longitudinal thread pair whose longitudinal threads engage at the same height with the transverse threads. This results, in combination with the flat transverse threads, in a wide and smooth support base for the paper web.

Materials appropriate for the longitudinal threads are, in particular, PET hydrolysis-stabilized polyester, PPS, PEEK, and PCTA. The materials suitable in particular for the transverse threads are PET hydrolysis-stabilized polyester, PPS, polysulfone, PEEK, PCTA, and PEN.

BRIEF DESCRIPTION OF THE DRAWING

The invention is illustrated in more detail, with reference to an exemplary embodiment, in the drawings, in which.

DETAILED DESCRIPTION OF THE INVENTION

Figure 1:
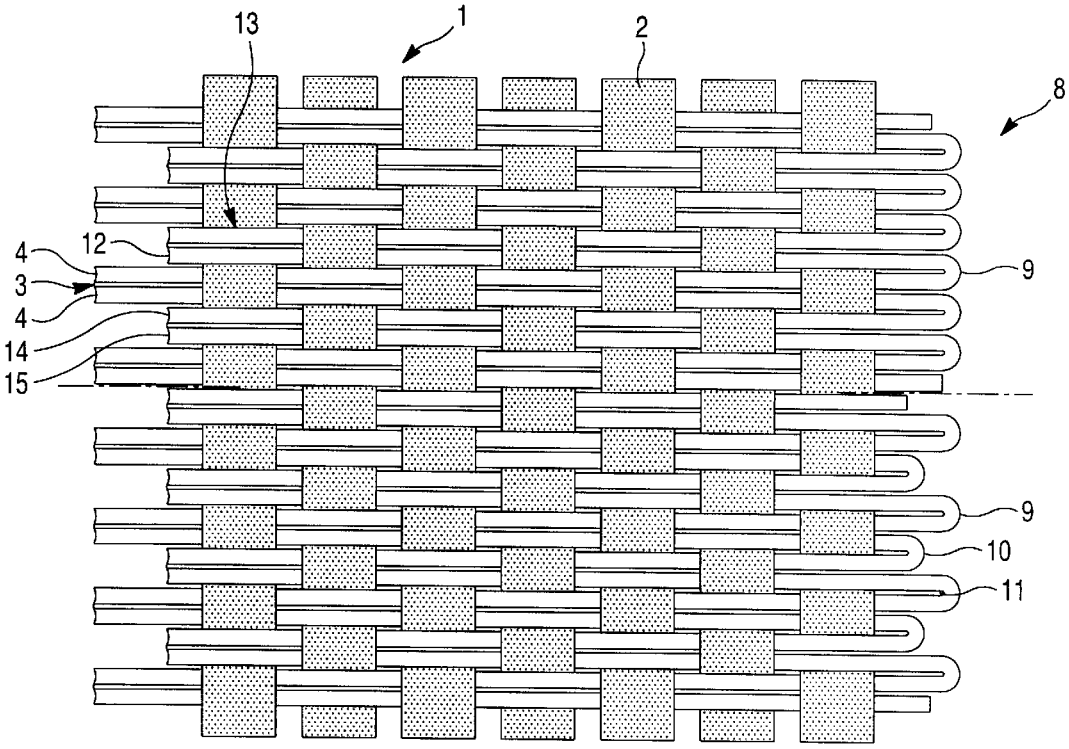
FIG. 1 shows a plan view of the end portion of a dryer fabric.

It is evident from the plan view in FIG. 1 that dryer fabric 1 has on the paper side wide flat transverse threads (labeled 2 by way of example) that are engaged by longitudinal thread pairs (labeled 3 by way of example), each longitudinal thread pair 3 comprising two longitudinal threads (labeled 4, 5 by way of example) that extend at the same height within a longitudinal thread pair 3. Longitudinal thread pairs 3 engage with flat transverse threads 2 in the manner of a plain weave, i.e. they engage one flat transverse thread 2 on the paper side and the following flat transverse thread 2 on the machine side and then once again the subsequent flat transverse thread 2 on the paper side.

Figure 2:
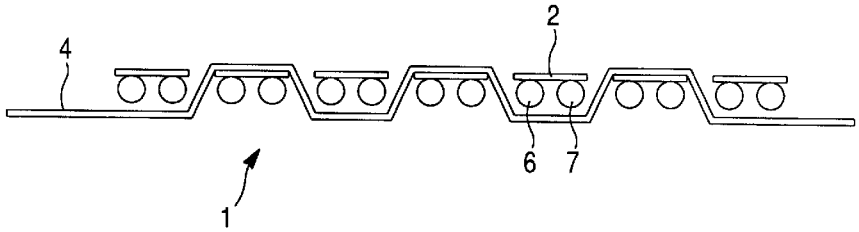
FIG. 2 shows a longitudinal section through the portion shown in FIG. 1.

The engagement of longitudinal threads 4, 5 with flat transverse threads 2 is even more clearly evident from FIG. 2. This Figure shows that two round transverse threads (labeled 6, 7 by way of example) lie in contact with the underside of each flat transverse thread 2 and support it in paired fashion. Any shifting of round transverse threads 6, 7 relative to flat transverse threads 2 is prevented by the alternating engagement of flat transverse threads 2 and the associated round transverse threads 6, 7 by longitudinal thread pairs 3.

In the version below the dot-dash line, longitudinal threads 4, 5 of longitudinal thread pairs 3 form, at end 8 of dryer fabric 1, large loops (labeled 9 by way of example) and small loops (labeled 10 by way of example). Large loops 9 alternate with small loops 10. The version above the dot-dash line illustrates only large loops 9. It is understood that this depiction is intended to show two different types of end 8, but that only one version of the loops is present in one dryer fabric. Large loops 9 form loop eyes 11; these loops 9 can be made to overlap with corresponding large loops at the other end of dryer fabric in such a way that all the loop eyes 11 align and thus form a passage through which, in known fashion, an inserted wire can be slid in order to join ends 8 and form a so-called inserted wire seam.

The special aspect of the loop configuration is principally the fact that after the loop has been formed, one longitudinal thread 4 of a longitudinal thread pair 3 is woven back in such a way that it forms the adjacent longitudinal thread 12 of the adjacent longitudinal thread pair 13. The same is true of longitudinal thread 5 of longitudinal thread pair 3, i.e. as a result of formation of the loop, it becomes the adjacent longitudinal thread 14 of the adjacent longitudinal thread pair 15. The result is that there is little twisting of loops 9, 10, and dryer fabric 1 has a highly uniform weave pattern on the paper side.

Figure 3:
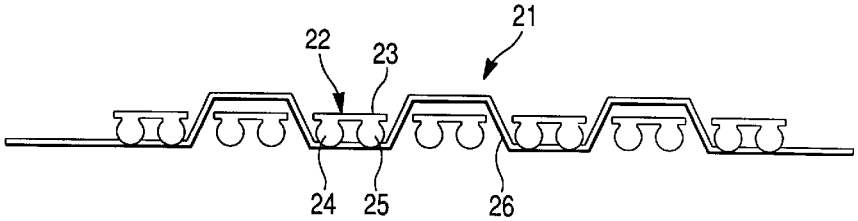
FIG. 3 shows a longitudinal section through a dryer fabric that is modified, as compared to the dryer fabric shown in FIGS. 1 and 2, in terms of the transverse threads.

Dryer fabric 21 depicted in FIG. 3 differs from dryer fabric 1 according to FIGS. 1 and 2 only in terms of the configuration of the transverse threads (labeled 22 by way of example). These transverse threads 22 are configured as one-piece shaped cords. Each transverse thread 22 has on the paper side one flat transverse thread 23, onto whose machine side two longitudinal ribs 24, 25 are shaped next to one another. Longitudinal ribs 24, 25 have a substantially circular cross section, and increase the flexural strength of the respective flat transverse thread 23.

Transverse threads 22 are engaged by longitudinal threads 26 in the same way as the combination, in dryer fabric 1 shown in FIGS. 1 and 2, of flat transverse threads 2 and round transverse threads 6, 7 lying in contact with them on the machine side.

What is claimed is:

1. A paper machine clothing (1), having a paper side provided for the support of a paper web and a machine side facing away therefrom, the paper machine clothing (1) comprising a fabric made of longitudinal and transverse threads (2, 4, 5, 6, 7, 12, 14) and the transverse threads constituting a paper-side thread system made up of flat transverse threads (2) and a machine-side thread system made up of round transverse threads (6, 7), wherein at least two round transverse threads (6, 7) on the machine side lie in contact with at least some of the flat transverse threads (2), and one flat transverse thread (2) and its round transverse threads (6, 7) lying in contact with it are together engaged by at least some of the longitudinal threads (4, 5, 12, 14).

2. The paper machine clothing as defined in claim 1, wherein the round transverse threads (6, 7) lying in contact on the machine side with one flat transverse thread (2) lie in contact with one another.

3. The paper machine clothing as defined in claim 1, wherein the sum of the diameters of the round transverse threads (6, 7) that lie in contact with one flat transverse thread (2) is no greater than its extension in the longitudinal direction of the paper machine clothing (1).

4. The paper machine clothing as defined in claim 1, wherein no further transverse threads are present besides the flat transverse threads (2) and the round transverse threads (6, 7) lying in contact with them.

5. The paper machine clothing as defined in claim 1, wherein some of the longitudinal threads engage the flat transverse threads only on the paper side, and otherwise engage only with round transverse threads that extend between the round transverse threads lying in contact with the flat transverse threads.

6. The paper machine clothing as defined in claim 1, wherein the flat threads (23) have a length of 1 to 25 mm and a thickness of from 0.2 to 1 mm.

7. The paper machine clothing as defined in claim 1, wherein the longitudinal threads (4, 5, 12, 14, 26) are configured as flat longitudinal threads.

8. The paper machine clothing as defined in claim 7, wherein the flat longitudinal threads (4, 5, 12, 14, 26) have a width of 0.5 to 5 mm, and a thickness of 0.2 to 1 mm.

9. The paper machine clothing as defined in claim 1, wherein the longitudinal threads (4, 5, 12, 14, 26) each engage only one flat transverse thread (2).

10. The paper machine clothing as defined in claim 1, wherein in the case of at least some of the longitudinal threads (4, 5, 12, 14, 26), each two adjacent longitudinal threads (4, 5) form a longitudinal thread pair (3, 13, 15) whose longitudinal threads (4, 5) engage at the same height with the transverse threads (2, 6, 7, 22).

11. The paper machine clothing as defined claim 1, wherein the flat threads (23) have a length of 10 to 15 mm and a thickness from 0.2 to 1 mm.

12. A paper machine clothing (21), having a paper side provided for the support of a paper web and a machine side facing away therefrom, the paper machine clothing (1) comprising a fabric made of longitudinal and transverse threads (22, 26), wherein at least some of the transverse threads (22) arc configured as flat transverse threads (23) onto which are shaped longitudinal ribs (24, 25) having a circular cross section projecting on the machine side.

13. The paper machine clothing as defined in claim 12, wherein the longitudinal ribs (24, 25) have a rectangular, trapezoidal, and/or round cross section.

14. The paper machine clothing as defined in claim 12, wherein two or three longitudinal ribs (24, 25) are shaped next to one another.

15. A paper machine clothing (21), having a paper side provided for the support of a paper web and a machine side facing away therefrom, the paper machine clothing (1) comprising a fabric made of longitudinal and transverse threads (22, 26), wherein at least some of the transverse threads (22) are configured as flat transverse threads (23) having a first flat face with side edges and longitudinal ribs (24, 25) attached inwardly from said edges and projecting on the machine side.

16. The paper machine clothing as defined in claim 15, wherein the longitudinal ribs (24, 25) have a rectangular, trapezoidal, and/or round cross section.

17. The paper machine clothing as defined in claim 15, wherein two or three longitudinal ribs (24, 25) are shaped next to one another.

18. The paper machine clothing as defined in claim 15, wherein the flat threads (23) have a length of 1 to 25 mm, and a thickness of from 0.2 to 1 mm.

19. The paper machine clothing as defined in claim 15, wherein the longitudinal threads (4, 5, 12, 14, 26) are configured as flat longitudinal threads.

20. The paper machine clothing as defined in claim 19, wherein the flat longitudinal threads (4, 5, 12, 14, 26) have a width of 0.5 to 5 mm, and a thickness of 0.2 to 1 mm.

21. The paper machine clothing as defined in claim 15, wherein the longitudinal threads (4, 5, 12, 14, 26) each engage only one flat transverse thread (2).

22. The paper machine clothing as defined in claim 15, wherein in the case of at least some of the longitudinal threads (4, 5, 12, 14, 26), each two adjacent longitudinal threads (4, 5) form a longitudinal thread pair (3, 13, 15) whose longitudinal threads (4, 5) engage at the same height with the transverse threads (2, 6, 7, 22).

* * * * *